United States Patent [19]

Arai et al.

[11] 3,988,265

[45] Oct. 26, 1976

[54] DETERGENT COMPOSITIONS CONTAINING 1-HYDROXYALKANE-SULFATE, SURFACTANTS, INORGANIC BUILDER, HAVING GOOD RINSING CHARACTERISTICS

[75] Inventors: Haruhiko Arai, Narashino; Kaoru Tsujii, Funabashi; Hisashi Kasai, Wakayama, all of Japan

[73] Assignee: Kao Soap Co., Ltd., Tokyo, Japan

[22] Filed: Aug. 7, 1974

[21] Appl. No.: 495,433

[30] Foreign Application Priority Data

Aug. 10, 1973 Japan ..... 48-90154

[52] U.S. Cl. ..... 252/532; 252/535; 252/539; 252/551; 252/552; 252/553

[51] Int. Cl.[2] ..... C11D 3/065; C11D 1/12

[58] Field of Search ..... 252/551, 532, 550, 321, 252/358, 2, 553, 533, 4; 260/458

[56] References Cited

FOREIGN PATENTS OR APPLICATIONS 731,279 5/1932 France

OTHER PUBLICATIONS

Kyokai, J. of Oil Chemists Soc., Jap., vol. 2, No. 1, pp. 11–15 (1953).

Schwartz et al., Surface Active Agents and Detergents, vol. II, Interscience, (1958), pp. 59–60.

*Primary Examiner*—John D. Welsh

*Attorney, Agent, or Firm*—Woodhams, Blanchard and Flynn

[57] ABSTRACT

A detergent composition comprising a detergent system including as a main active detergent component an anionic surface active agent or a non-ionic surface active agent or both of these surface active agents, and incorporated therein, 3 to 50% by weight of a 1-hydroxyalkane-sulfate having 12 to 22 carbon atoms based on the amount of the detergent composition.

4 Claims, No Drawings

DETERGENT COMPOSITIONS CONTAINING 1-HYDROXYALKANE-SULFATE, SURFACTANTS, INORGANIC BUILDER, HAVING GOOD RINSING CHARACTERISTICS

BACKGROUND OF THE INVENTION

1. Field of the Invention

This invention relates to a detergent composition having such useful foaming characteristics that it produces rich foams at the washing step and the foams promptly disappear at the rinsing step.

In detergent compositions comprising as a main detergent component an anionic surface active agent or a non-ionic surface active agent, foams do not easily disappear at the rinsing step conducted after the washing step, and therefore, rinsing should be repeated several times.

It is therefore a primary object of this invention to provide a detergent composition including as a main active component an anionic surface active agent such as sodium linear-alkylbenzene-sulfonate and sodium α-olefinsulfonate or a non-ionic surface active agent such as polyoxyethylene alkyl ether and polyoxyethylene alkylphenyl ether, or both of these surface active agents, which can give rich foams sufficiently at the washing step and the foams will promptly disappear at the rinsing step.

SUMMARY OF THE INVENTION

In accordance with this invention, the above object can be attained by a detergent composition comprising a detergent system including an anionic surface active agent or a non-ionic surface active agent or both of these as a main active detergent component, and incorporated therein, 3 to 50% by weight of 1-hydroxyalkane-sulfate having 12 to 22 carbon atoms based on the amount of the detergent composition.

The 1-hydroxyalkane-sulfate to be used in this invention is a surface active compound, which can be prepared, for example, by sulfating an acetate of an unsaturated alcohol having 12 to 22 carbon atoms with concentrated sulfuric acid, neutralizing the resulting sulfated product with caustic alkali and hydrolyzing the acetate portion thereof. For instance, sodium 1-hydroxyoctadecane-9(or -10)-sulfate can be prepared by sulfating oleyl acetate with 98% sulfuric acid in n-pentane, neutralizing the sulfated product with sodium hydroxide and hydrolyzing the acetate portion thereof with 20% sodium hydroxide.

The surface active agent to be used in the detergent composition of this invention may be either an anionic surface active agent characterized by rich foams or a non-ionic surface active agent in which defoaming is difficult. As the anionic surface active agent, there can be employed, for example, linear and branched alkylbenzene-sulfonates having an alkyl chain of 10 to 18 carbon atoms, alkyl sulfates having an alkyl group of 10 to 18 carbon atoms, α-olefin-sulfonates having 14 to 22 carbon atoms, alkane sulfonates having 12 to 22 carbon atoms, polyoxyethylene(1-12 moles)alkyl($C_{12}$–$C_{18}$)ether sulfates, carboxyalkyl ether compounds of the formula $R—(OA)_nO(CH_2)_mCOOM$ in which n is zero or a positive integer of up to 100, R is an alkyl or alkenyl group of 8 to 24 carbon atoms or a phenyl group having an alkyl or alkenyl group of 8 to 18 carbon atoms, A is an alkylene group of 2 to 4 carbon atoms or a mixture of such alkylene groups, $m$ is 1 or 2, and M is a water solubility-imparting cation such as sodium, and salts of fatty acids having 12 to 20 carbon atoms. In these anionic surface active agents, the salts are usually sodium salts. As the non-ionic surface active agent, there can be employed, for example, ethylene oxide addition products of such hydrophobic compounds as alcohols having 12 to 18 carbon atoms, alkyl phenols having an alkyl group of 8 to 14 carbon atoms, sorbitan esters of fatty acids of 12 to 18 carbon atoms, and fatty acids having 12 to 20 carbon atoms. Of course, in this invention, it is possible to use such anionic surface active agent and such non-ionic surface active agent in combination.

The detergent composition of this invention can further comprise other components conventionally used for ordinary detergent compositions. The most representative one of such other components is a builder. As the builder, there can be employed, for example, neutral or alkaline inorganic builders, for example, polyphosphates such as sodium pyrophosphate and sodium tripolyphosphate, sodium sulfate, sodium carbonate, water-soluble sodium silicates having the general formula of $Na_2O.nSiO_2$ ($n = 1, 2, 2.5$) and sodium borate, and water-soluble organic builders such as sodium nitrilotriacetate, sodium citrate, sodium polycarboxylates, sodium carboxymethyl-cellulose, polyethyleneglycol, propyleneglycol and ethanol.

It will be understood that the adjuncts used in the detergent composition of the invention can be selected from among those conventionally used for this purpose in accordance with conventional practice. Since the present invention does not concern any discovery relating to such adjuncts, further description of them is believed unnecessary.

As mentioned above, 1-hydroxyalkane-sulfate to be used as the foam-controlling agent in the detergent composition of the present invention is incorporated in an amount of about 3 to about 50% by weight based on the amount of the entire detergent composition, though the optimum amount thereof depends on the kinds of other detergent components to be mixed together.

The detergent composition of this invention can be used as a detergent for clothes, a liquid kitchen detergent and a hair or body shampoo, and the detergent composition of this invention is very excellent in the washing power and the rinsing property.

This invention will be further described with reference to the following illustrative Examples, wherein "parts" refers to parts by weight.

EXAMPLE 1

| | |
|---|---|
| Sodium linear-alkylbenzene sulfonate (LAS) (average number of carbon atoms in the alkyl chain is 12) | 10 parts |
| 1-Hydroxyalkane-sulfate (indicated in Table 1) | 10 parts |
| Sodium tripolyphosphate | 25 parts |
| Sodium silicate | 8 parts |
| Sodium carbonate | 3 parts |
| Carboxymethylcellulose | 1 part |
| Sodium sulfate | 33 parts |
| Water | 10 parts |

A granular synthetic detergent composition consisting of the components as shown above was prepared. This was dissolved in city water at various concentrations indicated in Table 1 and 100 cc of each solution was charged in a columnar cylinder having a diameter of 64.5 mm. Then, an automatic revolving agitator having 4 agitation blades of a length of 50 mm and a width of 12 mm was disposed below the level of the test solution and revolved at 1,450 rpm for 6 minutes to examine the foaming state. Results are shown in Table 1.

Table 1

| Concentration of composition (% by weight) | LAS* | Foaming State (ml of foam volume) 1-Hydroxyalkane-sulfate 1** | 2** | 3** |
|---|---|---|---|---|
| 0.20 | 260 | 220 | 255 | 260 |
| 0.15 | 263 | 220 | 240 | 265 |
| 0.10 | 250 | 90 | 50 | 80 |
| 0.05 | 190 | 40 | 10 | 30 |

*LAS: LAS was used instead of the 1-hydroxyalkane-sulfate, and, therefore, this composition contained 20 parts by weight of LAS in total.
**1-hydroxyalkane-sulfate:
1: sodium 1-hydroxytetradecane-5(or -6)-sulfate
2: sodium 1-hydroxyoctadecane-9(or -10)-sulfate
3: sodium 1-hydroxyhexadecane-9(or -10)-sulfate As is apparent from the results shown in Table 1, in each of the detergent compositions of this invention incorporated with the 1-hydroxyalkane-sulfate high foaming is attained at the washing step and the rinsing property is highly improved.

EXAMPLE 2

| | |
|---|---|
| Sodium 1-hydroxyoctadecane-9 (or -10)-sulfate | 30 parts |
| Surface active agent (indicated in Table 2) | 10 parts |
| Sodium sulfate | 60 parts |

A neutral detergent composition of the above recipe was prepared and it was dissolved in city water at various concentrations indicated in Table 2, and the height (mm) of foams produced just after the addition of the solution was measured according to the Ross-Miles test method to determine the foaming power.

Table 2

| Surface Active Agent | | Concentration of Composition (% by weight) 0.20 | 0.15 | 0.10 | 0.05 |
|---|---|---|---|---|---|
| sodium linear-alkyl-benzene sulfonate (average number of carbon atoms in the alkyl chain: 12) | control* | 215 | 220 | 210 | 200 |
| | admixed** | 205 | 200 | 120 | 55 |
| sodium dodecyl sulfate | control | 200 | 205 | 195 | 150 |
| | admixed | 210 | 185 | 80 | 20 |
| sodium α-olefin-sulfonate | control | 220 | 215 | 210 | 210 |
| | admixed | 220 | 205 | 150 | 70 |
| sodium alkane-sulfonate (average number of carbon atoms: 15.3) | control | 215 | 200 | 200 | 190 |
| | admixed | 200 | 190 | 75 | 35 |
| sodium polyoxy-ethylene (3 mols) dodecyl ether sulfate | control | 195 | 200 | 190 | 155 |
| | admixed | 215 | 180 | 90 | 30 |
| polyoxyethylene (8 mols) dodecyl ether | control | 150 | 120 | 80 | 60 |
| | admixed | 200 | 160 | 60 | 20 |

*: In the control, the indicated surface active agent was used instead of the sodium 1-hydroxy-octadecane-9(or -10)-sulfate, and therefore, the amount incorporated of the respective surface active agent was 40 parts by weight in total.
**: The "admixed" indicates the composition of this invention having the above recipe, in which sodium 1-hydroxyoctadecane-9(or -10)-sulfate was incorporated.

EXAMPLE 3

In detergent compositions consisting of 40 parts of sodium 1-hydroxyoctadecane-9(or -10)-sulfate and sodium tetradecyl-sulfate in total and 60 parts of sodium sulfate, the mixing ratio of sodium 1-hydroxyoctadecane-9(or -10)-sulfate and sodium tetradecyl sulfate was changed and the change of foaming characteristics depending on the mixing ratio was examined. The measurements were conducted in the same manner as in Example 1. Test results of the foam heights observed, which were expressed in the mm unit, are shown in Table 3.

Table 3

| Concentration of Composition (% by weight) | Weight Ratio of Sodium 1-Hydroxyoctadecane-9(or -10)-Sulfate/Sodium Tetradecyl Sulfate 0/40 | 10/30 | 20/20 | 30/10 | 40/0 |
|---|---|---|---|---|---|
| 0.20 | 215 | 205 | 210 | 200 | 190 |
| 0.15 | 220 | 200 | 185 | 180 | 110 |
| 0.10 | 200 | 130 | 65 | 70 | 55 |
| 0.05 | 200 | 85 | 30 | 25 | 10 |

As is apparent from the results shown in Table 3, a better rinsing property can be obtained as the mixed amount of sodium 1-hydroxyoctadecane-9(or -10)-sulfate is higher.

EXAMPLE 4

This example is given to illustrate that the detergent composition of this invention has an excellent rinsing property under actual washing conditions.

| | |
|---|---|
| Sodium 1-hydroxyoctadecane-9 (or -10)-sulfate | 30 parts |
| Sodium tetradecyl sulfate | 10 parts |
| Sodium sulfate | 60 parts |

A granular synthetic detergent composition of the above recipe was prepared and 6 g of the composition was charged in a washing tub and dissolved in 3 l of city water. A wool sweater was rub-washed in this washing liquid 20 times, and the washing liquid was thrown away. The washed sweater was rinsed with 3 l of city water. If foams were left in the rinsing liquid, the rinsing operation was repeated. The number of repetition of this rinsing operation performed until no foams were left in the rinsing liquid was designated as the rinsing number.

The rinsing number was measured according to the above method. It was found that the rinsing number was 2 times in the case of the above composition incorporated with sodium 1-hydroxyoctadecane-9(or -10)-sulfate, but the rinsing number was 5 times in the case of a control composition incorporated with sodium tetradecyl sulfate instead of sodium 1-hydroxyoctadecane-9(or -10)-sulfate.

The embodiments of the invention in which an exclusive property or privilege is claimed are defined as follows:

1. A detergent composition effective for washing clothing, hair, kitchen articles and the like, consisting essentially of:

A. from 3 to 50 percent by weight of water-soluble 1-hydroxyalkane-sulfate having from 12 to 22 carbon atoms;

B. a water-soluble anionic organic surface active agent selected from the group consisting of linear and branched alkylbenzene sulfonates having an alkyl chain of 10 to 18 carbon atoms, alkyl sulfates having 10 to 18 carbon atoms, $\alpha$-olefin sulfonates having 14 to 22 carbon atoms, alkane sulfonates having 12 to 22 carbon atoms, polyoxyethylene(-1–12 mols)alkyl($C_{12}$–$C_{18}$) ether sulfates, carboxy alkyl ether compounds of the formula R-(OA)-$_n$O($CH_2$)$_m$COOM in which n is zero or a positive integer of up to 100, R is an alkyl or alkenyl group of 8 to 24 carbon atoms or a phenyl group having an alkyl or alkenyl group of 8 to 18 carbon atoms, A is an alkylene group of 2 to 4 carbon atoms, m is 1 or 2 and M is a water solubility-imparting cation and salts of fatty acids having 12 to 20 carbon atoms, or a water-soluble nonionic organic surface active agent being an ethylene oxide addition product of a compound selected from the group consisting of alcohols having 12 to 18 carbon atoms, alkyl phenols having an alkyl group of 8 to 14 carbon atoms, sorbitan esters of fatty acids of 12 to 18 carbon atoms and fatty acids having 12 to 20 carbon atoms, or a mixture of said anionic and nonionic surface active agents; and C. water-soluble neutral inorganic builder salts, or water-soluble alkaline inorganic builder salts, or water-soluble organic builders, or mixtures thereof.

2. A detergent composition according to claim 1, in which the 1-hydroxyalkane-sulfate is selected from the group consisting of sodium 1-hydroxytetradecane-5(or -6)-sulfate, sodium 1-hydroxyoctadecane-9(or -10)-sulfate, and sodium 1-hydroxyhexadecane-9(or -10)-sulfate.

3. A detergent composition according to claim 1, consisting essentially of 10 to 30 percent by weight of A, from 10 to 30 percent of B, and the balance is C.

4. A detergent composition as claimed in claim 1 in which component C is sodium pyrophosphate, or sodium tripolyphosphate, or sodium sulfate, or sodium carbonate, or water-soluble sodium silicates, or sodium borate, or sodium nitrilotriacetate, or sodium citrate, or sodium carboxylate, or sodium carboxymethyl cellulose, or polyethylene glycol, or polypropylene glycol, or ethanol, or mixtures thereof.

* * * * *